US009027951B2

(12) United States Patent
Holzer et al.

(10) Patent No.: US 9,027,951 B2
(45) Date of Patent: May 12, 2015

(54) CLIMBING AID WHICH CAN BE SECURED IN A DETACHABLE MANNER AS NECESSARY ONTO THE UNDERSIDE OF A SKI AND A SKI IN COMBINATION WITH A CLIMBING AID

(71) Applicant: ATOMIC Austria GmbH, Altenmarkt im Pongau (AT)

(72) Inventors: Helmut Holzer, St. Johann (AT); Markus Rehrl, Altenmarkt (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 59 days.

(21) Appl. No.: 13/680,436

(22) Filed: Nov. 19, 2012

(65) Prior Publication Data

US 2013/0134691 A1 May 30, 2013

(30) Foreign Application Priority Data

Nov. 24, 2011 (AT) ..... A 1740/2011

(51) Int. Cl.
*A63C 5/06* (2006.01)
*A63C 7/02* (2006.01)
*A63C 5/04* (2006.01)

(52) U.S. Cl.
CPC ... *A63C 7/02* (2013.01); *A63C 5/06* (2013.01); *A63C 5/0405* (2013.01)

(58) Field of Classification Search
CPC ..... A63C 7/00–7/04
USPC ..... 280/604
See application file for complete search history.

(56) References Cited

U.S. PATENT DOCUMENTS 2,055,757 A * 9/1936 Tolman ..... 280/609
2,071,220 A * 2/1937 Eugen ..... 280/609
2,162,888 A * 6/1939 Held et al. ..... 280/604
2,184,791 A * 12/1939 Broome ..... 280/610

(Continued)

FOREIGN PATENT DOCUMENTS

AT 329 417 5/1976
AT 350 945 6/1979

(Continued)

OTHER PUBLICATIONS

2010 K2 Skis Backside Tech, Porters Blog—PortersTahoe.com, 22 Sep. 2009.

(Continued)

*Primary Examiner* — Hau Phan
*Assistant Examiner* — Bryan Evans
(74) *Attorney, Agent, or Firm* — Collard & Roe, P.C.

(57) ABSTRACT

A climbing aid attached releasably to a ski underside includes a flexible, strip-like carrier layer with a first longitudinal end connectible to a front tip ski section and a distally opposite second longitudinal end, an adhesive side adherable to the ski underside and a flat side opposite the adhesive side including at least one climbing aid section inhibiting backwards sliding and at least one sliding section with greater slidability. The ski has a front, upwardly bent front section, which is not in contact with flat ground in the unloaded state of the ski and extends over a longitudinal section of between at least 20% and 50% of the ski length. The sliding section extends from its first longitudinal end over a longitudinal section of between at least 20% and 50% of the length of the carrier layer and over the entire width of the carrier layer.

18 Claims, 5 Drawing Sheets

(56) References Cited

U.S. PATENT DOCUMENTS

| | | | | |
|---|---|---|---|---|
| 3,178,194 | A * | 4/1965 | Buchmuller | 280/604 |
| 3,980,312 | A | 9/1976 | Buttner | |
| 5,221,104 | A | 6/1993 | Bejean et al. | |
| 5,667,238 | A | 9/1997 | Sarver | |
| 8,408,579 | B2 | 4/2013 | Bourgier et al. | |
| 8,684,393 | B2 | 4/2014 | Puget et al. | |
| 2008/0085817 | A1 | 4/2008 | Brentlinger et al. | |
| 2008/0185817 | A1 | 8/2008 | Gyr | |

FOREIGN PATENT DOCUMENTS

| | | | |
|---|---|---|---|
| CH | 219 054 | | 5/1942 |
| CH | 570 178 | | 12/1975 |
| CH | 637839 | A5 * | 8/1983 |
| CH | 656 318 | A5 | 6/1986 |
| CH | 700 590 | | 9/2010 |
| DE | 1 149 653 | | 5/1963 |
| DE | 93 04 437 | | 9/1994 |
| EP | 1 925 344 | A1 | 5/2008 |
| EP | 1 925 345 | | 5/2008 |
| EP | 2 082 787 | A1 | 7/2009 |
| EP | 2 295 120 | A1 | 3/2011 |
| EP | 2 343 107 | A1 | 7/2011 |
| FR | 2 301 274 | | 9/1976 |
| FR | 2 652 271 | | 3/1991 |
| WO | WO 2010/087721 | | 8/2010 |

OTHER PUBLICATIONS

Ski on, Climbing skins get revamped for the season, trends backcountry ski, SNEWS magazine 2009, page 16.

European Search Report of EP 12 19 3956, dated Mar. 6, 2013, with English translation of relevant parts.

* cited by examiner

CLIMBING AID WHICH CAN BE SECURED IN A DETACHABLE MANNER AS NECESSARY ONTO THE UNDERSIDE OF A SKI AND A SKI IN COMBINATION WITH A CLIMBING AID

CROSS REFERENCE TO RELATED APPLICATIONS

Applicant claims priority under 35 U.S.C. §119 of Austrian Application No. A 1740/2011 filed on Nov. 24, 2011, the disclosure of which is incorporated by reference.

The invention relates to a climbing aid for releasable attachment as necessary to the underside of a ski as well as a combination of a climbing aid in connection with a ski, as described in the preamble of claims 1 and 2.

Climbing aids, which are secured in a detachable manner as necessary onto the underside of skis in order traverse steep ground as rapidly and easily as possible, are known in many different configurations from the prior art. Such climbing aids usually comprise a skin-like means that inhibits sliding backwards, and said climbing aids are also referred to colloquially as climbing skins. Climbing skins of this kind are usually provided on their active or effective surface with a plurality of fine hairs, with said hairs being aligned and fixed to the carrier material such that during a sliding movement in a first direction or in the direction of the desired advance movement the sliding resistance is a low as possible relative to the ground and during a movement of the climbing aid in the opposite direction the sliding resistance is as high as possible or a repelling effect can be achieved relation to the ground. In addition to known climbing skins there are also climbing aids with sawtooth-like scale profiles, by means of which a high level of slidability can also be achieved in one direction and in the opposite direction the repelling effect or backwards sliding inhibiting effect is a high as possible.

It is also known to provide only parts of the attachable climbing aid with backwards sliding inhibiting means and to give the remaining sections of said climbing aid higher slidability in comparison, as proposed for example in DE 93 04 437 U1 or CH 700 590 B1. In this way it is intended that a compromise can be achieved between the best possible climbing ability and best possible sliding ability.

It is also known to provide a climbing skin split in longitudinal direction comprising two climbing skin strips, said climbing skin strips being assigned respectively to the longitudinal side edges of a ski. The individual climbing skin strips are directionally flexible in order to adjust to the size or side contour of the ski, as described in EP 1 925 345 A1. However, the implementation of such a construction is relatively time-consuming and requires a high degree of dexterity. In addition, the mechanical robustness of such an embodiment is only satisfactory to a limited degree.

Different from the climbing aid means that can be attached as necessary it is also known to provide cutaway or recessed grooves in the running sole of skis in the longitudinal direction of the skis, into which grooves strips of backwards sliding inhibiting means are inserted and fixed permanently. Longitudinal grooves of this kind in the running sole require complex, mechanical processing or cutting processes as part of the production of the ski body. Furthermore, said longitudinal grooves formed on the ski side have sharp-edged transitions at least at their end sections which have a negative effect on the sliding behavior of the ski body. Furthermore, by having backwards sliding inhibiting climbing aids recessed into the longitudinal grooves the effectiveness of the latter on the ground is impaired. Such backwards sliding inhibiting means that are fixed permanently into grooves or other recesses in the running sole or are replaceable by using mechanical coupling devices are disclosed for example in FR 2 652 271 A1, CH 219 054 A, AT 350 945 B, FR 2 301 274 A1, DE 1 149 653 A, CH 570 178 A5 or AT 329 417 B. In addition to requiring a complex and expensive production sequence for creating such skis with integrally arranged climbing aid measures for suppressing unwanted backwards sliding, skis of this kind are not very satisfactory with regard to their sliding performance when skiing downwards.

The problem addressed by the present invention is that of creating a backwards sliding inhibiting climbing aid for skis, which effectively inhibits backwards sliding, has the best possible sliding properties for downwards skiing and makes it possible to save as much energy as possible when traversing steep ground and can also be produced as inexpensively as possible. Furthermore, the objective is to improve the combination of ski and backwards sliding inhibiting climbing aid and their technical interaction.

Said problem is solved by the invention on the one hand by the subject matter of claim 1 and independently by the subject matter of claim 2. Advantageous embodiments of the invention are the subject matter of the dependent claims.

According to the invention a climbing aid is formed which is intended to be attached as required to the underside of a ski. Said climbing aid comprises a flexible, strip-like carrier layer, with a first longitudinal end for connection with the front tip of a ski and a distally opposite other longitudinal end, where the length of the carrier layer corresponds essentially to the length of the corresponding ski. The climbing aid has an adhesive side, which is provided for adhering to the underside or the running sole of a ski. On the flat side opposite the adhesive side at least one backwards sliding inhibiting climbing aid section and at least one sliding section with much greater slidability are formed. The sliding section extends in this case from the first longitudinal end at least over a longitudinal section of between 20% and 50% of the length of the carrier layer and at the same time over the entire width of the carrier layer. With regard to the longitudinal direction of the carrier layer following said sliding section at least one climbing aid section is formed which at least partly covers the carrier layer in width direction and extends in relation to the longitudinal direction of the carrier layer without interruption up to the other longitudinal end of the carrier layer.

According to a further embodiment of the invention a ski is provided in combination with a climbing aid, which climbing aid is provided to be attached as necessary to the underside of the ski. The climbing aid comprises a flexible, strip-like carrier layer with a first longitudinal end for connecting to the front tip section of the ski and a distally opposite other longitudinal end, the length of the carrier layer corresponding essentially to the length of the ski. Said climbing aid has an adhesive side provided for adhering to the underside of the ski. On the flat side opposite the adhesive side at least one backwards sliding inhibiting climbing aid section and at least one sliding section with much greater slidability are formed.

The ski has an upwardly bent front section, which in the unloaded state of the ski is not in contact with flat ground, whereby said bent up front section extends over a ski longitudinal section of between 20% and 50% of the ski length. In combination therewith the sliding section of the climbing aid extends from its first longitudinal end at least over a longitudinal section of between 20% and 50% of the length of the carrier layer and at the same time over the entire width of the carrier layer. With regard to the longitudinal direction of the carrier layer following said front sliding section of the climbing aid at least one climbing aid section is formed which at least partly covers the carrier layer.

The measures according to the invention have the advantage that the behavior of the climbing aid per se and also that of the climbing aid and ski can be optimized in relation to the climbing phase and the downwards skiing phase. Mainly the said coordinated combination of the ski and climbing aid achieves these advantages. In particular, the climbing aid according to claim 1 or 2, which is detachable as necessary, has the advantage of being a climbing aid which provides good climbing assistance. Furthermore, it is possible for the corresponding climbing skin to be removed completely from the ski body for longer descents, in particular for long deep snow descents, in order in this way to make use of the optimal sliding properties of the original running sole, in particular the running surface coating of the ski. For short distances or descents between individual climbing passages it is also possible to leave the climbing aid on the underside of the ski and also achieve the best possible slidability in these phases and thereby an energy-saving forwards movement. Thus when climbing with such a climbing aid an advantageous relationship is achieved between the climbing ability and backwards sliding inhibition and sliding ability for covering relatively short, steep or almost flat sections of ground.

An essential advantage of the configuration or combination according to the invention is that a relatively energy-saving climb can be achieved with skis with a relatively long blade section. Such skis with a relatively large, front blade section are often denoted as "rocker" type skis. The said climbing aid therefore provides as far as possible an energy-saving climb, mainly in connection with touring skis of the "rocker" type. With these types of "rocker touring skis" or mountaineering skis in a rocker configuration the front part or the extensive blade section of the ski body when walking are mainly in contact with the ground via the sliding section of the climbing aid. When pushing the ski forwards together with the climbing aid attached underneath said ski is inhibited as little as possible when walking, so that relatively smooth progress is ensured by alternately pushing forward the skis of a ski pair. As during an ascent in many of the forwards steps the blade area of a ski pair with relatively large bent up blades or relatively long blade sections (so-called rocker configuration) comes into contact with the snow relatively often or relatively extensively, in said part sections the climbing aid has comparatively good or relatively good sliding properties, the total amount of force required during a climb is reduced by means of said climbing aid. Furthermore, said climbing aid provides good grip and sufficiently prevents sliding back, since mainly the section adjoining the blade section is responsible for this or comes into its own.

Thus by way of the measures according to the invention an optimum compromise is achieved between the climbing ability or backwards sliding inhibition and sliding ability or energy saving. Since the sliding section of the said climbing aid is also less prone to moisture penetration than a climbing aid section consisting of a plurality of hairs, by means of the solution according to the invention also a weight advantage can be achieved, in particular compared to embodiments in which the blade area is provided over the whole surface with a climbing aid formed by a climbing skin. However, for short descents in deep snow the measures according to the invention also have advantages with regard to optimized sliding ability and the greater sliding speed which can be achieved thereby. In addition, by means of the relatively extensive blade section provided with a sliding surface also climbing over off-piste deep snow can be made slightly easier, which is an advantage in particular for a lead skier responsible for forming tracks in deep snow, with regard to saving energy and ease of movement.

The climbing aid section can extend with regard to its longitudinal direction from the front sliding section, in particular from the rear end of the front sliding section without interruption up to the other longitudinal end of the carrier layer. In this way the section that is loaded most intensively during the climb is provided with material which inhibits sliding backwards, whereby the performance is improved with regard to the climbing ability or climbing behavior.

It is advantageous if the climbing aid section extends into a standing area of a user, in particular into the area of the binding assembly or shoe standing area relative to the ski over the entire width of the carrier layer or ski. In particular, it is advantageous if the climbing aid section extends with the means for inhibiting sliding backwards into the shoe standing area or into the area of the ski binding mounted on the ski over the entire ski width. In this way the sections responsible with a one-sided load with the body weight of the user for an intensive inhibition of backwards sliding, are provided with backwards sliding inhibiting means over the largest possible area.

It can also be advantageous if a longitudinal extension of the bent up front section of the ski and a longitudinal extension of the sliding section of the climbing aid have essentially the same dimensions. In particular, it is advantageous if the bent up blade or front section of the ski and the front sliding section of the climbing aid positioned to be essentially congruent or corresponding with one another have almost the same length. In this way an advantageous behavior or an optimum compromise is achieved between the parameters climbing ability and sliding behavior during the ascent or during descents with an attached climbing aid.

It is also expedient if the longitudinal extension of the sliding section of the climbing aid is dimensioned such that it ends in the vicinity of the front contact point or at the front contact point of the running surface of the unloaded ski relative to flat ground. Alternatively, the sliding section of the climbing aid from the first or front longitudinal end of the ski in the direction of the other or rear longitudinal end of the ski ends slightly before the front contact point of the running surface or running sole closest to the ski tip relative to flat ground. Also in this way a favorable relationship is achieved between the achievable climbing ability and sliding behavior of the combination of a ski of the rocker type and the suitably designed combined climbing aid.

In addition, the climbing aid section of the climbing aid can comprise two spaced apart climbing aid strips, which are assigned to the longitudinal side edges of the carrier element or the side edge elements of the ski. In this way the total area of backwards sliding inhibiting material is reduced or minimized, whereby however also when crossing or traversing slopes a sufficient amount of resistance to backwards sliding is ensured. In particular, the area of sliding surface is as great as possible without worsening the ability to climb.

It is possible in this case that the two spaced apart climbing aid strips are located in a transitional section between the front sliding section and the climbing aid section. In particular, in this way with regard to the ski longitudinal direction a transitional area is created which partly comprises backwards sliding resistant material and partly comprises a material which has by comparison high slidability. In particular, in this way in a transitional area between a sliding section which is particularly slidable over the entire width and a climbing aid section effective over the entire width an intermediate section is created so that abrupt transitions are avoided and a continual or comparatively fluid transition is created between the corresponding sections.

Furthermore, between spaced apart climbing aid strips at least one middle climbing aid strip extending in the longitudinal direction of the ski can be formed. In this way an even more harmonious or uniform transition is made possible between the sliding section and climbing aid section.

According to one development two further spaced part climbing aid strips are formed which run from a climbing aid section, which extends within a standing area of a user over the entire width of the carrier layer or ski, up to the other longitudinal end of the carrier layer. In this way the ratio or the interaction between the climbability and sliding behavior can be optimized further in relation to forwards movement.

In particular, the climbing aid section in plan view of the flat side can have an essentially I-shaped or H-shaped outline. Also in this way a shaping or course of the sliding inhibiting sections is created which creates on the one hand a basis for an embodiment that is as lightweight as possible and on the other hand ensures a good ratio between the backwards sliding inhibiting effect and slidability relative to the desired advancing direction.

It is expedient if the climbing aid section extends in relation to the longitudinal extension of the climbing aid over the remaining longitudinal section not occupied by the front sliding section, in particular if a longitudinal extension is between 50 and 80% of the length of the carrier layer or ski. In this way the part of the climbing aid or ski, which is pressed actively or relatively intensively against the ground, is provided with the backwards sliding inhibiting means, whereby the effect of the climbing aid is as high as possible.

The above definitions or proportions refer to the processed length relative to flat ground. This is most effective with regard to the effective length and width ratios.

More advantageously the climbing aid section is formed by a pile, in particular by a skin or plush section with uniformly aligned hairs or bristles. In particular, the tips of the hairs or bristles point in the direction of the rear end of the ski. The effective area of the climbing aid section can protrude relative to a sliding surface of the at least one sliding section, so that the effect of the climbing aid section is high or is as effective as possible.

In order to achieve the increased sliding ability of the at least one sliding section of the climbing aid, the sliding section can be made of plastic or be provided with a plastic layer.

The carrier layer is made preferably from a fabric, in particular a textile fabric or other sufficiently expansion-resistant, flexible and tearing-resistant carrier material.

Lastly, it can also be expedient if the at least one sliding section of the climbing aid is formed by a plastic which is flowable in the processing state and then subsequently hardens and is applied onto the carrier layer and forms a sliding surface. In this way a particularly good sliding behavior can be achieved and at the same time the production costs can be kept as low as possible.

For a better understanding of the invention the latter is explained in more detail with reference to the following figures.

In a much simplified schematic representation:

Figure 1:
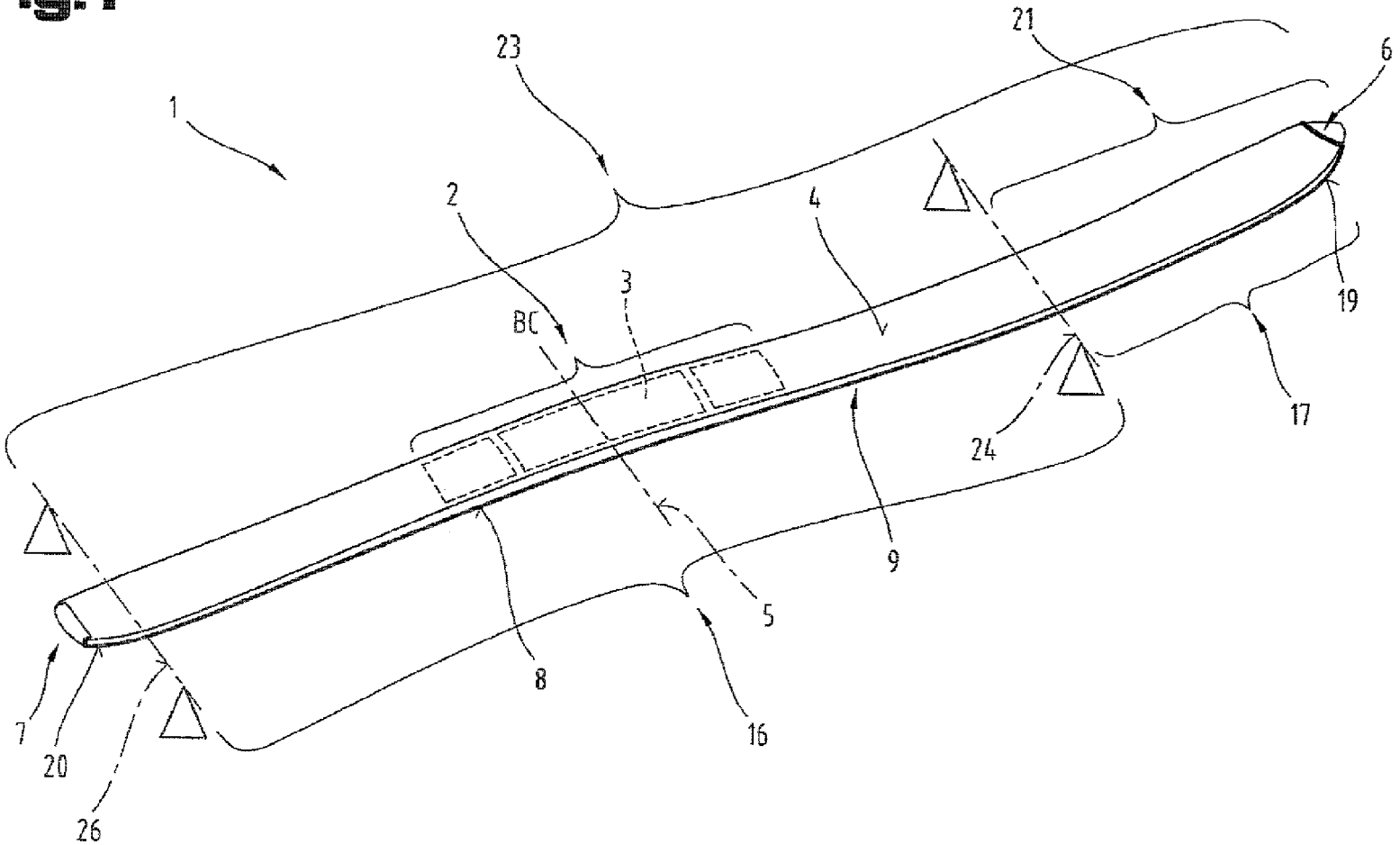
FIG. 1 shows a generic ski, to be used in pairs, with a climbing aid attached to the underside in perspective view from the right top and rear.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

FIGS. 1 to 4 show schematically and by way of example an embodiment of a ski 1, in particular a so-called touring or mountaineering ski. Said ski 1 is used in pairs and is designed in particular for touring ski sports and mountaineering. When practicing touring skiing or ski mountaineering it is often the case that longer climbing phases are followed by longer descending phases, in particular descents in deep snow are desirable and sought out. The action is thus mostly not on skiing trails or prepared pistes, unlike cross-country skiing or classical alpine skiing.

To obtain a better overview only one ski 1 of a pair of skis is shown for use in a pair. Furthermore, for simplicity the known binding device to be mounted on the top of the ski body, in particular a standard touring ski binding with a pivoting connection for a sports shoe relative to the ski body, is not shown in the drawings. The binding assembly area 2 or the shoe fitting area 3 on the upper side 4 of the ski body has been indicated schematically by dashed lines. The middle of the shoe fitting area 5 symbolized by a dash-dot line relative to the ski 1 is, as already known, off-center in relation to the total ski length, in particular in relation to the total length of the ski body within its rear part half. Accordingly, the front ski section with regard to the usual direction of movement between the shoe fitting center 5 and the ski tip 6 is longer in comparison than the rear ski section between the shoe fitting center 5 and the rear ski end 7 with regard the usual direction of movement.

In order to facilitate climbing up over the ground a climbing aid 8 is provided which is configured for securing to the underside 9 of the ski 1 and is detachable as necessary. The underside 9 of the ski 1 is formed by a standard running surface coating 10—FIG. 4—, which provides the best possible sliding properties relative to the respective ground, in particular on snow or ice. Preferably, the running surface coating 10 is delimited along its lateral longitudinal edges by edge elements 11, 12, in particular by so-called steel edges. The running surface coating 10 itself is preferably made of plastic, in particular polyethylene, and defines the lower end of the ski body. The underside 9 of the ski 1 is configured to have an even surface or to be planar apart from a possible track groove of marginal depth, in particular a depth of less than 2 mm. This means that the running surface coating 10 or the underside 9 of the ski 1 preferably does not have any grooves, cutaways or other depressions. The structurally independent climbing aid 8, which can be coupled to the ski 1 as necessary and connected to form a unit and can be removed or taken off as necessary from the ski 1, in particular from its underside 9, is relatively flexible and mostly in the form of a strip. The climbing aid 8 can thus be rolled or folded up so that it can be stored as compactly as possible for transport or storage or simply put into the rucksack of a user.

The detachable climbing aid 8 which can be attached as necessary preferably has an adhesive side 13 on its side facing the running surface coating 10. This adhesive side 13 is used for adhering or connecting to the underside 9 of the ski 1. In particular, the adhesive side 13 is formed by a full or partial adhesive layer 14 which allows the repeated adhesive attachment and removal of the climbing aid 8 from the ski 1 or from its plastic running surface coating 10. In particular, said adhesive layer 14 has long-lasting self-adhesive properties so that the climbing aid 8 can be adhered and removed multiple times from the running sole or the running surface coating 10 of the ski 1. The equivalent to such an adhesive layer 14 can be a different adhesive layer which for example is based on the principle of suction, on the principle of non-chemical adhesion or on the principle of the finest microbonds. The adhesive side 13 in addition to adhesive properties can also comprise other means for achieving adhesion to the underside 9 of the ski 1. The adhesive side 13 is mainly used so that the climbing aid 8 also in the convex section of the running surface coating 10 lies as far as possible without a gap or during active use for a long time closely on the running surface coating 10. In particular, in this way a gradual accumulation of snow or ice between the climbing aid 8 and the running surface coating 10 can be prevented.

Preferably, at least one longitudinal end 19, 20 of the climbing aid 8 is coupled detachably by means of a mechanical coupling device to the closest end section of the ski 1. Advantageously at least at the front longitudinal end 19 of the climbing aid 8 a mechanical coupling element is formed in order to be connected as necessary to the front end section, in particular to the ski tip 6 as necessary. In this way there is greater security to prevent unwanted release during the use of the climbing aid 8. The coupling element provided at the front and/or rear longitudinal end 19; 20 can be formed as already known by hooks, brackets, bolts, or extensions, rubber tensioners, buckles, magnetic fastenings and the like.

A flat side 15 of the climbing aid 8 opposite the adhesive side 13 comprises at least one backwards sliding inhibiting climbing aid section 16 and at least one sliding section 17 with greater slidability by comparison. The climbing aid section 16 has in this case a backwards sliding inhibiting effect, whereas the sliding section 17 has the highest possible slidability in any direction relative to the respective ground, in particular relative to snow or ice.

Figure 3:
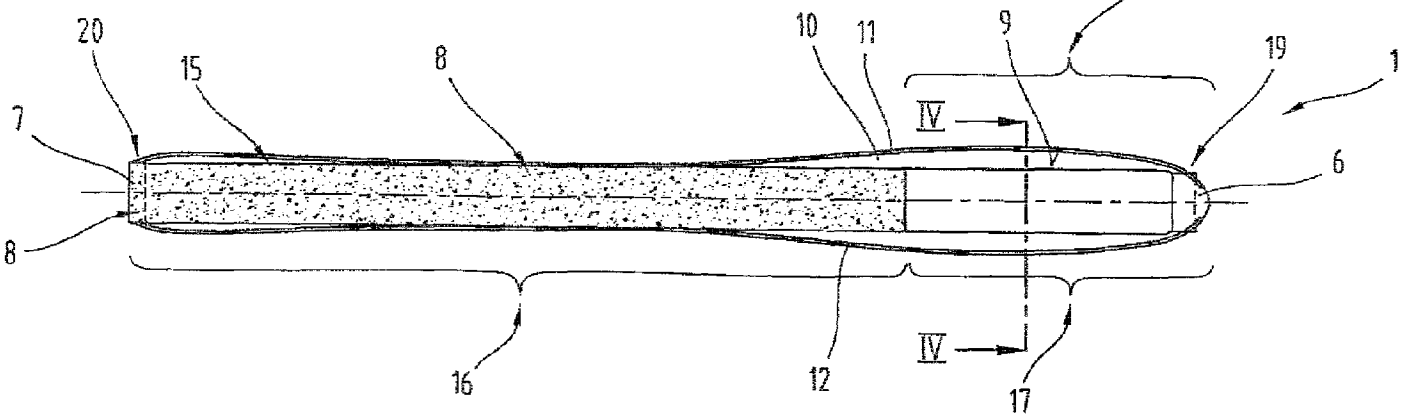
FIG. 3 shows the ski according to FIG. 1 in a view from below.
Figure 4:
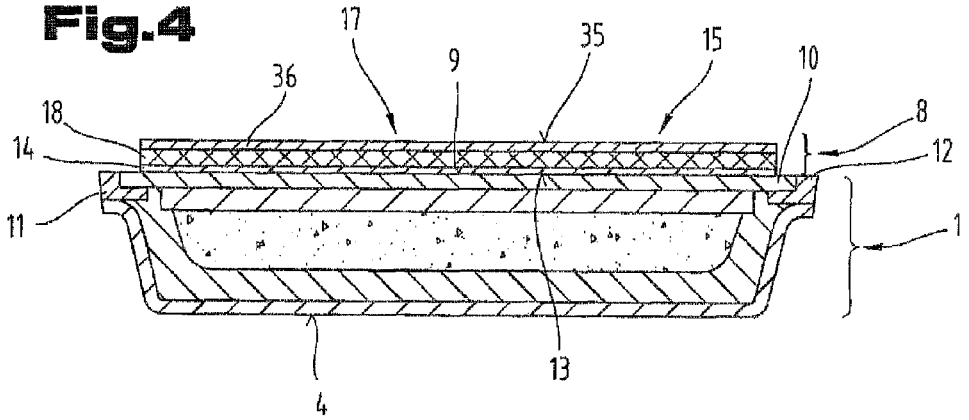
FIG. 4 shows the ski according to FIG. 1, in cross section along the lines IV-IV of FIG. 3.

As shown best in an overview of FIGS. 3, 4, the climbing aid 8 comprises a flexible, strip-like carrier layer 18 with a first longitudinal end 19 for connecting with the front tip section of a ski 1 and a distally opposite longitudinal end 20, wherein the length of the carrier layer 18 corresponds essentially to the length of the relevant ski 1. The carrier layer 18 is in this way configured to be sufficiently tear-resistant and provides the strength-providing element of the climbing aid 8. The carrier layer 18 can be formed in this case by a fabric or by another sufficiently tearing or tension resistant material that is as flexible as possible.

The sliding section 17 of the climbing aid 8 extends from the first longitudinal end 19 over a longitudinal section of between at least 20% and a maximum of 50% of the length of the carrier layer 18 and at the same time preferably over the entire width of the essentially strip-like carrier layer 18. In particular, it is expedient if the length of the sliding section 17 in the front end section of the climbing aid 8 assigned to the ski tip 6 is between 20% and 50%, preferably between at least 25% and up to 40%, preferably about 33%, of the length of the climbing aid 8 or the length of the ski 1.

In addition, in relation to the longitudinal direction of the carrier layer 18 following said sliding section 17 at least one climbing aid section 16 at least partly covering the carrier layer 18 in width direction is formed. Said climbing aid section 16 following the usual direction of movement on the sliding section 17 extends in relation to the longitudinal direction of the carrier layer 18 preferably without interruption up to the other longitudinal end 20 of the carrier layer 18, as illustrated by way of example in FIGS. 1-3.

Said climbing aid 8 is particularly effective and efficient in connection with a specially constructed or geometrically specially shaped ski 1 of the said rocker-type. Such ski constructions are also known as reverse camber or zero camber and banana constructions. These types of geometries ensure good lift in deep snow, and they are well-suited to the touring or mountaineering skis 1 mentioned in the present patent. Reverse camber essentially means negative pretensioning and this is actually the oldest form of ski. In these skis with negative pretensioning the ski center can also be more or less planar. In any case the front section 21 of the rocker skis described in this patent or the front blade section of a generic ski 1 has a relatively long edge which curves relatively quickly or more upwardly from the shoe fitting center 5 in the direction of the ski tip 6. This means that a generic ski 1 has a relatively distinctive or marked blade or front section 21, as illustrated schematically and by way of example in FIGS. 1, 2.

In particular, by means of a combination of the said climbing aid 8 in connection with a ski 1 of the "rocker type" the advantageous reciprocal effects described above are achieved. In particular, the climbing aid 8 formed by at least one climbing aid section 16 and partially by at least one sliding section 17 can be used or applied advantageously to skis 1, which have a relatively extensive upwardly bent front section 21, as shown schematically in FIGS. 1, 2. The bent up front section 21, which is relatively long in a rocker-ski 1 compared to a classical alpine or piste ski, is the section of the ski body which does not touch flat ground 22 in the unloaded state of the ski 1. With regard to the entire length, in particular to the processed or projected ski length 23 said bent up front section 21 extends over a ski longitudinal section that is between at least 20% and 50% of the ski length 23. In particular, the length of the upwards pointing blade or front section 21 of the ski 1 can be between 20% and 50%, preferably between at least 25% and up to 40%, preferably about 33%, of the length of the ski 1.

In any case such a ski 1 of the so-called rocker-type has a relatively early acting, gradually increasing front blade or front section 21, which improves the performance during descents in deep snow. In particular, by means of this relatively extensive blade or front section 21, which takes up more than 20% of the ski length 23, an optimized lift can be achieved for the front section of the ski body and thereby the unwanted sinking or burying of the ski tip 6 in the soft snow or in the deep snow can be avoided. The front section 21 which is convexly curved in relation to the underside 9 or in relation to the running surface can be between 20% and 50% of the ski length 23, in particular about 33% of the ski length 23.

The upwardly curved front section 21 of such rocker skis 1 can also be defined differently. In particular, said front section 21 is formed by the longitudinal section of the ski 1, which extends between the front contact or resting point 24 of an unloaded ski 1 relative to flat ground 22, in particular of a ski 1 not loaded by the body weight of a user, up to the front ski tip 6. Said front contact or resting point 24—according to FIG. 1, 2—is spaced apart by at least 20% to about 50%, often about 33%, of the ski length 23 from the front ski tip 6 in the direction of the rear ski end 7.

Figure 2:
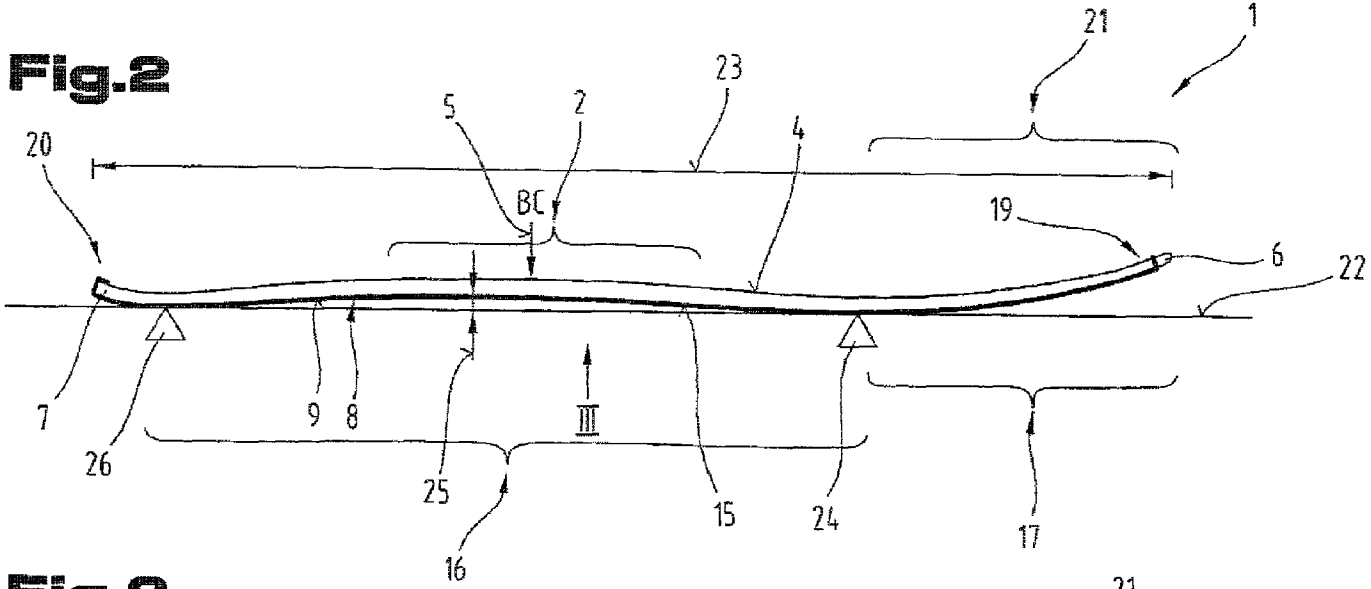
FIG. 2 shows the ski according to FIG. 1 in side view.

The pretensioned height 25 of the ski 1 provided if necessary is greatest in the area of the binding assembly area 2 or in the area of the shoe standing area 3, as shown in FIG. 2. The rear contact or resting point 26 of the underside 9 of the ski 1 in relation to a flat ground 22 is positioned compared to the front contact or resting point 24 or in relation to the longitudinal extension of the blade-side front section 21 closer to the rear ski end 7. The shoe standing center 5 can be provided approximately in the middle between the front and rear contact or resting point 24, 26.

As shown best in an overview of FIGS. 1 to 3, a longitudinal extension of the upwardly bent front section 21 of the ski 1 and a longitudinal extension of the sliding section 17 of the climbing aid 8 which can be attached as necessary can have essentially the same dimensions and can be aligned essentially congruently in relation to the position in ski longitudinal direction 23. The longitudinal extension of the sliding section 17 of the climbing aid 8, in particular the rear longitudinal end of the sliding section 17 in relation to the usual advancing direction, can end in the vicinity of the front contact or resting point 24 or at the front contact or resting point 24 of the running surface coating 10 of an unloaded ski 1 relative to flat ground 22. Without losing its effectiveness it is also possible for the sliding section 17 of the climbing aid 8 from the first longitudinal end 19 in the direction of the other longitudinal end 20 of the carrier layer 18 or the ski 1 to end slightly before said front contact or resting point 25 closest to the ski tip 6.

It is essential that with regard to the longitudinal direction of the carrier layer 18 or the ski 1 following said front sliding section 17 of the climbing aid 8 at least one climbing aid section 16 at least partly covers the carrier layer 18 with a backwards sliding inhibiting effect.

According to an advantageous embodiment the climbing aid section 16 extends in relation to the longitudinal direction of the climbing aid 8 or in relation to the longitudinal direction of the carrier layer 18 without interruption or as far as possible without interruption from the front sliding section 17 up to the other or rear longitudinal end 20 of the carrier layer 18. Slight interruptions in length or smooth end sections in the climbing aid section 16 are here considered to be largely without interruption.

The carrier layer 18 or the strength-providing layer of the climbing aid 8 can comprise, as shown in FIG. 3, parallel lateral delimiting edges. It is also possible, as indicated in FIG. 6, to provide lateral delimiting edges for the climbing aid 8, which are adjusted to the size or lateral contour of the ski 1 either completely or at least partly.

Figure 5:
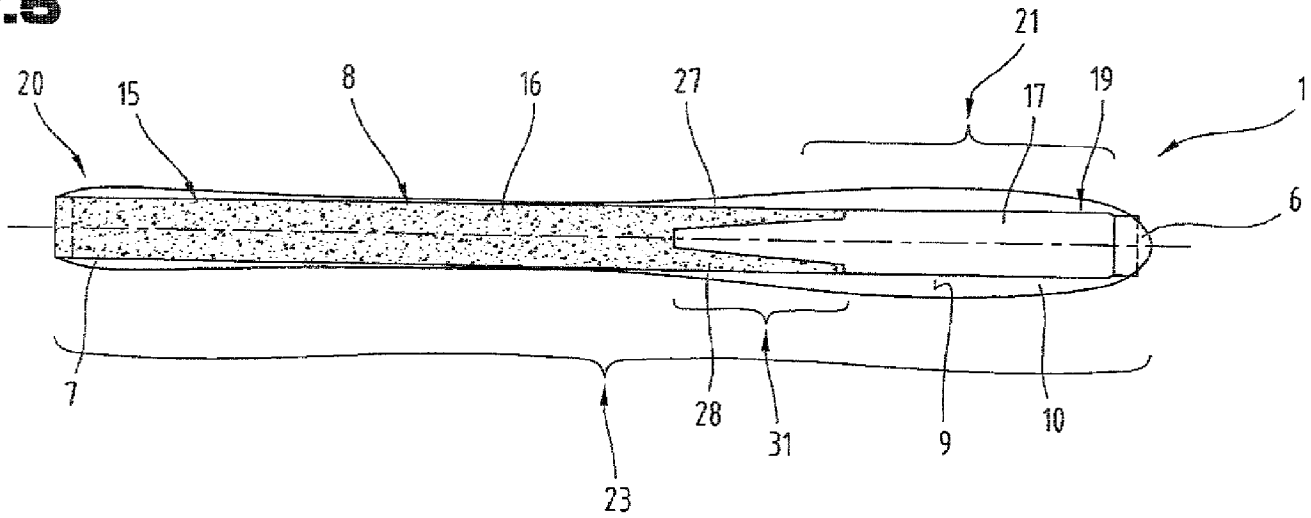
FIG. 5 shows another embodiment of the climbing aid on the underside of a ski.
Figure 6:
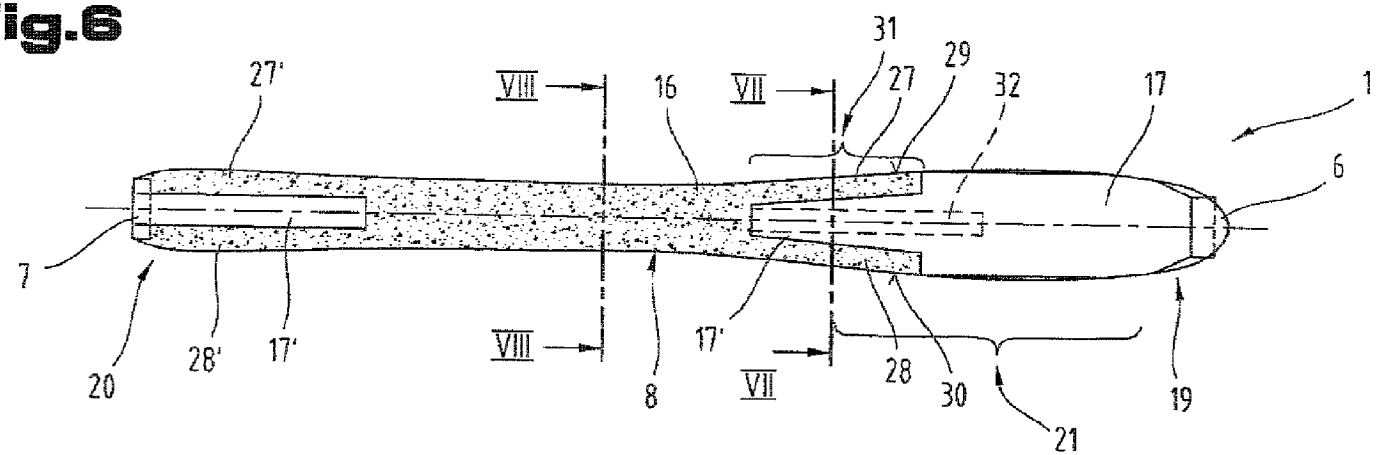
FIG. 6 shows a further embodiment of the climbing aid on the underside of a ski.

As also shown in the embodiment according to FIGS. 5, 6 it is also possible for the climbing aid section 16 to comprise two spaced apart climbing aid strips 27, 28, which are assigned respectively to the longitudinal side edges 29, 30 of the ski 1. It is expedient in this case to form the two spaced apart, lateral climbing aid strips 27, 28 in a transitional section 31 between the front sliding section 17 and the climbing aid section 16. The two spaced apart climbing aid strips 27, 28 can run essentially in a V-shape or diverge towards one another, as shown in the front section of the climbing aid section 16 according to FIGS. 5, 6.

It is also possible—FIG. 6—to provide two additional spaced apart climbing aid strips 27', 28', which run from the climbing aid section 16 up to the other or rear longitudinal end 20 of the carrier layer 18, as shown by way of example in FIG. 6. A sliding section 17' preferably formed between the side climbing aid strips 27', 28' has either parallel, lateral delimiting edges or V-shaped delimiting edges, as shown in the front end section of the climbing aid section 16 according to FIG. 6. The climbing aid section 16 can extend at least within a standing area of a user or be congruent to the shoe standing area 3—FIG. 1—preferably over the entire width of the carrier layer 18 or the ski 1.

According to an optional development between the spaced apart climbing aid strips 27, 28 at least one middle climbing aid strip 32 can be formed extending in longitudinal direction, as indicated in FIG. 6 by dashed lines.

It is practical if the climbing aid section 16 of the climbing aid 8 inhibiting the backwards sliding in plan view or in relation to the flat side 15 facing the ground 22 has an essentially U-shaped or I- or H-shaped outline, as shown by way of example in FIG. 6.

It is expedient if the climbing aid section 16 of the climbing aid 8 extends in relation to its longitudinal extension over the remaining longitudinal section of the carrier layer 18 not covered by the sliding section 17. Accordingly, the longitudinal extension of the climbing aid section 16 is between 50% and 80% of the length of the carrier layer 18 or the assigned ski. The above ratios or proportions relate mostly to the whole ski length 23, whereby the ski length 23 is defined by the drawn length relative to flat ground 22.

Figure 7:
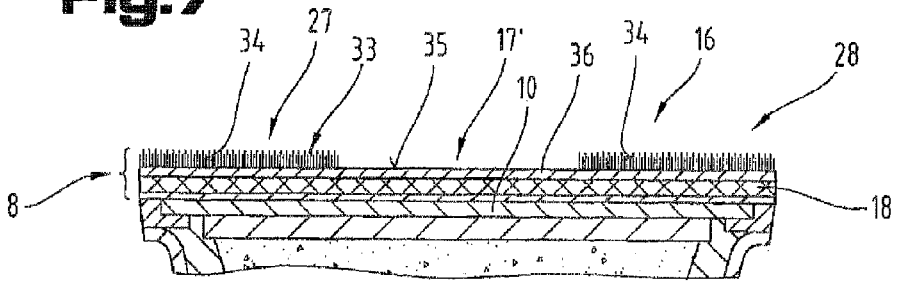
FIG. 7 shows a cross section of a ski and climbing aid according to lines VII-VII in FIG. 6.
Figure 8:
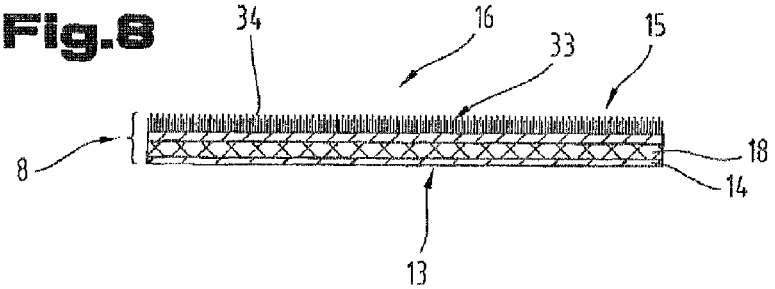
FIG. 8 shows a cross section of the climbing aid according to lines VIII-VIII in FIG. 6.

As shown best in FIGS. 7, 8, the climbing aid section 16 is preferably formed by a pile 33. A known pile 33 of this kind comprises a plurality of backwards sliding inhibiting hairs 34. As shown best in FIG. 7, an effective or backwards sliding inhibiting surface of the climbing aid section 16 can be arranged to project or overhang relative to a sliding surface 35 of at least one sliding section 17 or 17'. This means that the tips or the free ends of the hairs 34 protrude or project over the effective sliding surface 35 of the at least one sliding section 17, 17'.

The at least one sliding section 17 of the climbing aid 8 can be made of plastic. By comparison the carrier layer 18 is preferably made from a textile fabric or other carrier material. The carrier layer 18 can also be made of plastic.

The at least one sliding layer 36 of the climbing aid 8 can be formed by a plastic, which is flowable in the processing state and hardens subsequently, and which is applied onto the carrier layer 18 and forms the at least one sliding surface 35 or the sliding layer 36 of the climbing aid 8.

Figure 9:
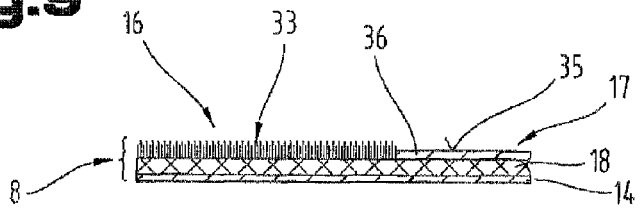
FIG. 9 shows another embodiment of the climbing aid in partial cross section.

According to the embodiment of FIG. 9 it is also possible that the pile 33 or its hairs are anchored in the carrier layer 18 or the surface of the carrier layer 18. Sections of the support element recessed by the pile 33 or the hairs define the at least one sliding section 17 of the climbing aid 8. The slidability or wearing resistance of the at least one sliding section 17 can be improved by a friction-reducing coating or by a sliding layer 36 made of plastic applied onto the carrier layer 18.

Figure 10:
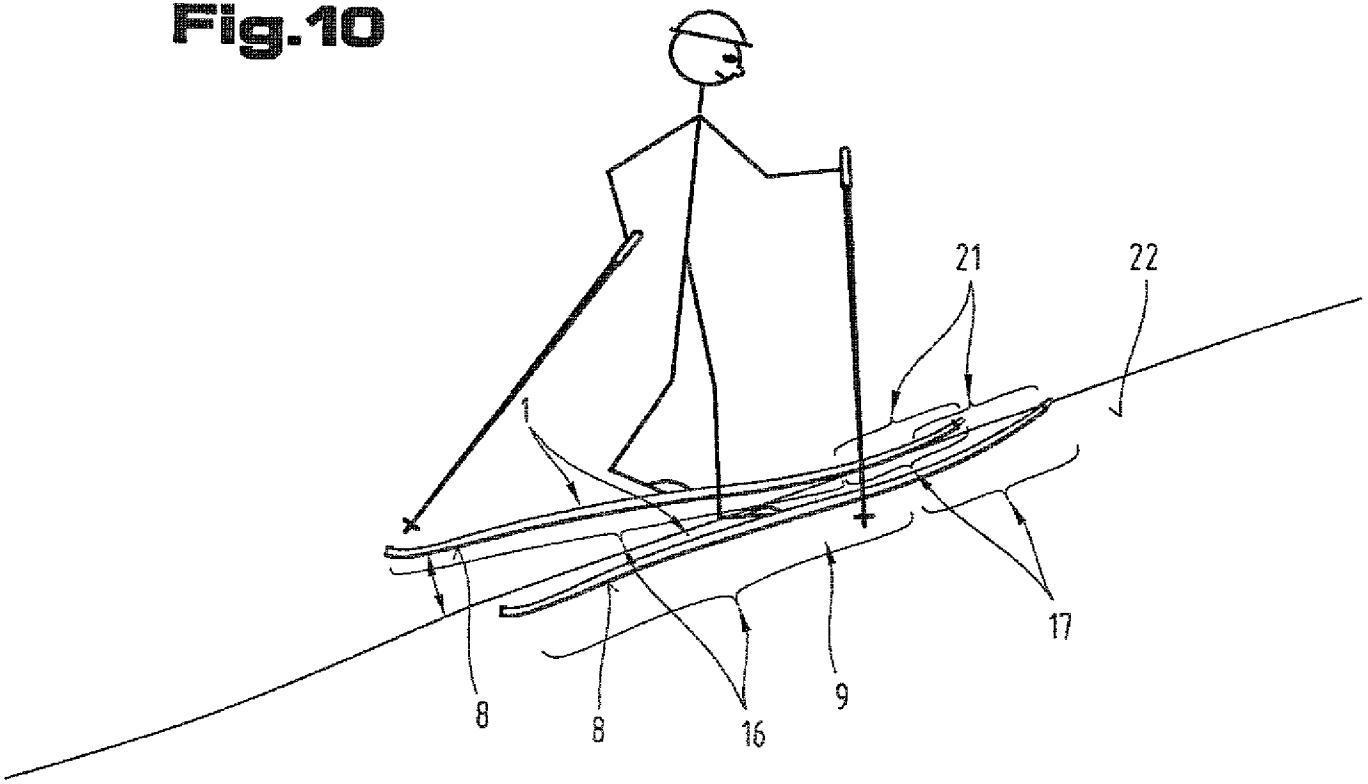
FIG. 10 shows a principle view for illustrating a phase from the movement sequence during forwards movement with the said combination of ski and climbing aid.

FIG. 10 shows the functioning of the climbing aid 8 or combination of the climbing aid 8 and a generic ski 1 or pair of rocker type skis. It can be seen that the front upwardly curved front section 21 of the rocker type skis 1 when loaded by the body weight of the user either does not come into contact with the ground or only comes into slight contact with the ground. At the moment shown the right ski 1 is loaded almost with the total body weight of the user. The front section 21 of the rocker-ski 1 in this case hardly touches the ground so that a backwards sliding inhibiting means in this front section 21 on the underside 9 of the ski 1 would not be expedient or only of little use. Rather a backwards sliding inhibiting means in the convex upwardly curved front section 21 would lead in some circumstances to increased cost or a greater weight of the climbing aid 8.

However, it may be the case that the lifted ski 1 when walking (in the moment shown the left ski 1 of the user) lies with its front section 21 on the ground 22 and touches the ground. During this step the (left) ski 1 with the climbing aid 8 secured to the underside 9 has to be pushed forwards or upwards. The sliding section 17 of the climbing aid 8, which is assigned roughly to the front upwardly curved front section 21 of the ski 1, facilitates as far as possible a strength-saving forwards movement, as friction is reduced relative to the ground 22 in these phases of walking. Particularly when climbing upwards or in deep snow this is an advantage for the user of the said combination of rocker ski 1 and adapted climbing aid 8. With each step there is a corresponding change in the relationships or conditions of the left and right ski 1 relative to the ground 22 on snow or ice.

The exemplary embodiments show possible embodiment variants of the climbing aid 8 or the ski 1 combined therewith, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

As a point of formality it should be noted that for a better understanding of the structure of the climbing aid 8 or the ski 1 the latter have been represented not to scale in part and/or are enlarged and/or reduced in size.

The problem addressed by the independent solutions according to the invention can be taken from the description.

Mainly the individual embodiments shown in FIGS. 1-4; 5; 6-8; 9; 10 can form the subject matter of independent solutions according to the invention. The problems and solutions according to the invention can be taken from the detailed descriptions of said figures.

LIST OF REFERENCE NUMERALS

1 Ski
2 Binding mounting area
3 Shoe fitting area
4 Top side
5 Shoe fitting center
6 Ski tip
7 Ski end
8 Climbing aid
9 Underside
10 Running surface coating
11 Edge element
12 Edge element
13 Adhesive side
14 Adhesive layer
15 Flat side
16 Climbing aid section
17 Sliding section
18 Carrier layer
19 Longitudinal end
20 Longitudinal end
21 Front section
22 Ground
23 Ski length
24 Contact or resting point
25 Pretensioned height
26 Contact or resting point
27, 27' Climbing aid strip
28, 28' Climbing aid strip
29 Longitudinal side edge
30 Longitudinal side edge
31 Transitional section
32 Climbing aid strip
33 Pile
34 Hairs
35 Sliding surface
36 Sliding layer

The invention claimed is:

1. A climbing aid (8) for releasable attachment as necessary to the underside (9) of a ski (1), comprising a flexible, strip-like carrier layer (18), with a first longitudinal end (19) for connecting to the front tip section of a ski (1) and a distally opposite other longitudinal end (20), wherein the length of the carrier layer (18) corresponds essentially to the length of the relevant ski (1), a self-adhesive side (13) for adhering to the underside (9) of a ski (1), a flat side (15) opposite the self-adhesive side (13) comprising at least one climbing aid section (16) which inhibits backwards sliding and at least one sliding section (17) which has greater slidability by comparison, wherein the sliding section (17) extends from the first longitudinal end (19) over a longitudinal section of between at least 20% and 50% of the length of the carrier layer (18) and at the same time over the entire width of the carrier layer (18), wherein with regard to the longitudinal direction of the carrier layer (18) following said sliding section (17) at least one climbing aid section (16) is formed which covers the carrier layer (18) at least partly in width direction, which climbing aid section extends in relation to the longitudinal direction of the carrier layer (18) without interruption up to the other longitudinal end (20) of the carrier layer (18), and wherein said climbing aid (8) is adapted to be used in connection with a ski (1) having an upwardly bent up front section (21), which in the unloaded state of the ski (1) is not in contact with flat ground (22), whereby said bent up front section (21) extends over a ski longitudinal section of between 20% and 50% of the ski length (23).

2. A ski (1) in combination with a climbing aid (8), which is provided for releasable attachment as necessary to the underside (9) of the ski (1), wherein the climbing aid (8) comprises a flexible, strip-like carrier layer (18) with a first longitudinal end (19) for connecting to the front tip section of the ski (1) and a distally opposite other longitudinal end (20), and wherein the length of the carrier layer (18) corresponds essentially to the length of the ski (23), and comprising a self-adhesive side (13) formed on the climbing aid (8) for adhering to the underside (9) of the ski (1), and a flat side (15) opposite the self-adhesive side (13) comprising at least one climbing aid section (16) which inhibits backwards sliding and at least one sliding section (17) which has greater slidability by comparison, wherein the ski (1) has a bent up front section (21) which in the unloaded state of the ski (1) does not come into contact with flat ground (22), said bent up front section (21) extending over a longitudinal section between at least 20% and 50% of the ski length (23), and wherein the sliding section (17) of the climbing aid (8) extends from its first longitudinal end (19) over a longitudinal section of between at least 20% and 50% of the length of the carrier layer (18) and at the same time over the entire width of the carrier layer (18), and wherein with regard to the longitudinal direction of the carrier layer (18) following said front sliding section (17) of the climbing aid (8) at least one climbing aid section (16) is formed which covers the carrier layer (18) at least partly.

3. The ski in combination with a climbing aid, configured as claimed in claim 2, wherein the climbing aid section (16) extends in relation to its longitudinal direction from the front sliding section (17) without interruption up to the other longitudinal end (20) of the carrier layer (18).

4. The ski in combination with a climbing aid, configured as claimed in claim 2, wherein the climbing aid section (16) extends within a standing area of a user over the entire width of the carrier layer (18) of the ski (1).

5. The ski in combination with a climbing aid, configured as claimed in claim 2, wherein a longitudinal extension of the bent up front section (21) of the ski (1) and a longitudinal extension of the sliding section (17) of the climbing aid (8) have essentially the same dimensions.

6. The ski in combination with a climbing aid, configured as claimed in claim 1, wherein the longitudinal extension of the sliding section (17) of the climbing aid (8) ends in the vicinity of the front contact or resting point (24) or the front contact or resting point (24) of the running surface or underside (9) of the unloaded ski (1) relative to flat ground (22), or from the first longitudinal end (19) in the direction of the other longitudinal end (20) of the carrier element (18) or ski (1) ends slightly before said front contact or resting point (24) closest to the ski tip (6).

7. The ski in combination with a climbing aid, configured as claimed in claim 1, wherein the climbing aid section (16) comprises two climbing aid strips (27, 28) spaced apart from one another, which are assigned respectively to the longitudinal side edges (29, 30) of the ski (1).

8. The ski in combination with a climbing aid, configured as claimed in claim 7, wherein the two spaced apart climbing aid strips (27, 28) are formed in a transitional section (31) between the front sliding section (17) and the climbing aid section (16).

9. The ski in combination with a climbing aid, configured as claimed in claim 7, wherein between the spaced apart climbing aid strips (27, 28) at least one middle climbing aid strip (32) is formed extending in the longitudinal direction of the ski (1).

10. The ski in combination with a climbing aid, configured as claimed in claim 1, wherein two additional climbing aid strips (27', 28') spaced apart from one another are formed, which run from a climbing aid section (16) extending within a standing area of a user over the entire width of the carrier layer (18) or the ski (1), up to the other longitudinal end (20) of the carrier layer (18).

11. The ski in combination with a climbing aid, configured as claimed in claim 1, wherein the climbing aid section (16) in a plan view of the flat side (15) has an essentially U-shaped or essentially I-shaped or H-shaped outline.

12. The ski in combination with a climbing aid, configured as claimed in claim 1, wherein the climbing aid section (16) extends in relation to the longitudinal extension of the carrier layer (18) over the remaining longitudinal section not covered by the front sliding section (17).

13. The ski in combination with a climbing aid, configured as claimed in claim 1, wherein the ski length (23) is defined by the processed length relative to flat ground (22).

14. The ski in combination with a climbing aid, configured as claimed in claim 1, wherein the climbing aid section (16) is formed by a pile (33) comprising a plurality of hairs (34) which inhibit backwards sliding, and wherein the backwards sliding inhibiting surface of the climbing aid section (16) projects over a sliding surface (35) of the at least one sliding section (17, 17').

15. The ski in combination with a climbing aid, configured as claimed in claim 1, wherein the at least one sliding section (17, 17') is made of plastic.

16. The ski in combination with a climbing aid, configured as claimed in claim 1, wherein the carrier layer (18) is made from a fabric.

17. The ski in combination with a climbing aid, configured as claimed in claim 1, wherein the at least one sliding section (17, 17') is made from a plastic which is flowable in the processing state and hardens subsequently, which is applied onto the carrier layer (18) and forms a sliding surface (35).

18. The ski in combination with a climbing aid, configured as claimed in claim 12, wherein the remaining longitudinal section not covered by the front sliding section (17) extends longitudinally between at least 50% and 80% of the length of the carrier layer (18) or the ski (1).

* * * * *